US008516893B2

(12) United States Patent
Giordano et al.

(10) Patent No.: US 8,516,893 B2
(45) Date of Patent: Aug. 27, 2013

(54) MODIFIED PRESSURE SENSOR FOR DETECTING OPERATING PARAMETERS OF AN ELECTRIC HOUSEHOLD APPLIANCE FEATURING A RELATIVELY MOVABLE COMPONENT

(75) Inventors: Sergio Giordano, Caselle T-SE (IT); Igor Kranjc, Tolmin (SI)

(73) Assignee: Illinois Tool Works Inc., Glenview, IL (US)

( * ) Notice: Subject to any disclaimer, the term of this patent is extended or adjusted under 35 U.S.C. 154(b) by 133 days.

(21) Appl. No.: 13/132,846

(22) PCT Filed: Dec. 4, 2009

(86) PCT No.: PCT/US2009/066720

§ 371 (c)(1),
(2), (4) Date: Aug. 3, 2011

(87) PCT Pub. No.: WO2010/065822

PCT Pub. Date: Jun. 10, 2010

(65) Prior Publication Data

US 2012/0017689 A1 Jan. 26, 2012

(30) Foreign Application Priority Data

Dec. 5, 2008 (IT) ..... TO2008A0904

(51) Int. Cl.
*G01L 9/14* (2006.01)
*G01L 9/10* (2006.01)

(52) U.S. Cl.
USPC ..... 73/722; 73/728; 73/735

(58) Field of Classification Search
None
See application file for complete search history.

(56) References Cited

U.S. PATENT DOCUMENTS

| | | | | |
|---|---|---|---|---|
| 2,992,561 | A | 7/1961 | Burt, Jr. | |
| 2007/0179433 | A1 * | 8/2007 | Jonsson et al. | 604/31 |
| 2008/0041710 | A1 | 2/2008 | Kranjc | |
| 2008/0257055 | A1 | 10/2008 | Giordano | |
| 2008/0264111 | A1 * | 10/2008 | Giordano | 68/12.04 |
| 2010/0307236 | A1 * | 12/2010 | Giordano | 73/299 |
| 2012/0131999 | A1 * | 5/2012 | Lesjak et al. | 73/299 |

FOREIGN PATENT DOCUMENTS

| | | | |
|---|---|---|---|
| DE | 9306961 | U1 | 7/1993 |
| EP | 1726702 | A1 | 11/2006 |
| FR | 2767194 | A1 | 2/1992 |
| WO | 2007034292 | A1 | 3/2007 |
| WO | 2007034294 | A1 | 3/2007 |

OTHER PUBLICATIONS

Italian Search Report for IT TO2008000904 dated Oct. 16, 2009.
ISR for PCT/US2009/066720 dated Feb. 4, 2010.

* cited by examiner

*Primary Examiner* — Andre Allen
(74) *Attorney, Agent, or Firm* — Lowe Hauptman & Ham LLP

(57) ABSTRACT

A modified inductive pressure sensor for detecting operating parameters of an electric household appliance such as a washing or drying machine, provided with a relatively movable component with respect to the carcass (tank or basket), of the type including a rigid casing accommodating a deformable membrane sensitive to hydraulic pressure, a core made of ferromagnetic material and operatively associated to the membrane, and a winding fixed to the casing and operatively coupled to the core to form a variable inductance inductor; wherein a mass is accommodated within the casing and in immediate proximity of said membrane, free to move with respect to the casing in at least one direction corresponding to the axis of the winding.

20 Claims, 2 Drawing Sheets

MODIFIED PRESSURE SENSOR FOR DETECTING OPERATING PARAMETERS OF AN ELECTRIC HOUSEHOLD APPLIANCE FEATURING A RELATIVELY MOVABLE COMPONENT

RELATED APPLICATIONS

The present application is national phase of PCT/US2009/066720 filed Dec. 4, 2009, and claims priority from Italian Application Number TO2008A000904 filed Dec. 5, 2008.

TECHNICAL FIELD

The present invention relates to a modified pressure sensor, or pressure switch, for detecting operating parameters of an electric household appliance featuring a relatively movable component with respect to the carcass of the electric household appliance itself, such as for example the tank or basket of a washing machine, drying machine, or the like.

BACKGROUND ART

It is known that in electric household appliances of the aforesaid type, a number of operating parameters should be known in order to ensure correct operation thereof, such as for example the uniformity degree of distribution of the laundry in the basket, the pressure and/or amount of feeding water, etc.

French patent application FR-A-2767194 describes a system for detecting some of these parameters using a pressure switch (pressure transducer) connected to the water feeding system of the electric household appliance and integrally coupled to a fluid-tight tank containing the rotating basket of the electric household appliance (washing or drying machine); as known, the tank is connected to the carcass of the electric household appliance, which supports it, by means of elastic, possibly damped elements, whereby it is relatively movable with respect to the carcass, upon the load applied thereto by the basket containing, in use, the laundry to be washed or dried.

The pressure switch includes a rigid casing accommodating a deformable membrane sensitive to hydraulic pressure, a core made of ferromagnetic material and fastened to the membrane, and a winding fixed to the casing and operatively coupled to the core to form a variable inductance inductor. The movements of the membrane are opposed by a low-stiffness spring or a pair of opposed, low-stiffness springs, so that the vibrations to which the movable member of the electric household appliance is subjected in use are transmitted to the pressure switch and in particular to the membrane, the movement of which, at least during some steps of the operating cycle of the electric household appliance, does not depend only on the differential pressure acting on the membrane, but also on the movements induced on the membrane itself by the vibrations, thus generating an electric signal responsive in direction and amplitude of the vibration of the basket.

However, the described detecting system is not free from drawbacks; in fact, it may by relatively inaccurate because the contrast springs should be calibrated so as to allow the membrane to move due to the vibrations in addition to pressure. For the same reason, the pressure switch provided so as to be inserted in such a system is relatively large in size; finally, mounting the pressure switch to the movable member of the electric household appliance is quite difficult.

DISCLOSURE OF INVENTION

It is the object of the present invention to obviate the described drawbacks by providing a modified pressure sensor for detecting operating parameters of an electric household appliance featuring a relatively movable component with respect to the carcass of the electric household appliance itself, e.g. the tank or basket of a washing or drying machine, which is small-sized, low-cost, easy to be assembled, reliable to be operated, and which allows to highly accurately detect the hydraulic pressure or water level in the basket as well as the vibrations of the basket itself.

The present invention thus relates to a modified pressure sensor for detecting operating parameters of an electric household appliance of the aforesaid type, as defined in claim 1.

In particular, the electric household appliance includes a relatively movable component with respect to a carcass of the electric household appliance, e.g. a tank or a basket, and the pressure sensor of the invention comprises a rigid casing accommodating a deformable membrane sensitive to hydraulic pressure, a core made of ferromagnetic material and operatively associated to the membrane for moving inside the casing in response to a deformation of the membrane, and a winding fixed to the casing and operatively coupled to the core to form a variable inductance inductor; according to the invention, it further comprises a mass accommodated in the casing in the immediate proximity of the membrane, which is free to move with respect to the casing in at least one direction corresponding to the axis of the winding and so that the inductor is adapted to emit an electric signal in response to a variation of the position of said mass induced, in use, by a variation of the position of the relatively movable member with respect to the carcass.

According to a preferred embodiment of the invention, the movable mass consists of a ball freely accommodated within a seat inside the casing and arranged opposite to the inductor with respect to said membrane; the latter integrally carries a tubular element mounted within the seat for guiding the ball, so that the movements of the ball are transmitted to the membrane, thus deforming it.

In a second embodiment of the invention, instead, the movable mass consists of the same ferromagnetic core of the inductor, which is however axially and slidingly mounted onto a guiding pin integrally carried by the membrane on the side of the winding and coaxially to the latter, so as to be carried by the membrane for moving, in use, in response to the deformation of the latter, while being able to simultaneously move in relation to the membrane in response to the variation of position of the relatively movable member of the electric household appliance with respect to the carcass.

Thereby, the vibrations which are transmitted by the electric household appliance to the casing of the pressure sensor are amplified by the movement of the movable mass, which alternatively moves in the direction of the winding axis, thus generating in both embodiments of the invention an additional movement of the core, which is added to that caused by the pressure variations, thus generating a pulsing signal which depends on the vibrations to which the electric household appliance is subjected in use.

Such a signal is produced without needing to intervene on the elastic features of the contrast spring(s) of the membrane movement, thus ensuring a high detection accuracy, for both the hydraulic pressure (corresponding to the liquid level in the washing tank) and the vibration amplitude and frequency. Furthermore, the signal amplification allowed by the presence of a free mass within the sensor allows to fit the same so as not to be necessarily integral with the movable member of the electric household appliance (tank or basket), such as in FR-A-2767194, but to be also integral with the carcass of the electric household appliance only, which in case of load imbalance in the basket also vibrates although to a considerably less extent than the basket or tank.

Finally, in the embodiment in which the movable mass consists of the same ferromagnetic core as the inductor, there is no transmission of additional movements/deformations to the membrane and there is no intervention by the contrast springs, whereby an even more accurate, low-cost, small-sized sensor is obtained, because there is no need for an additional element (ball) and for accommodating the same.

BRIEF DESCRIPTION OF THE DRAWINGS

Further features and advantages of the present invention will be apparent from the following description of two non-limitative embodiments thereof, carried out with reference to the figures of the accompanying drawings, in which.

BEST MODE FOR CARRYING OUT THE INVENTION

Figure 1:
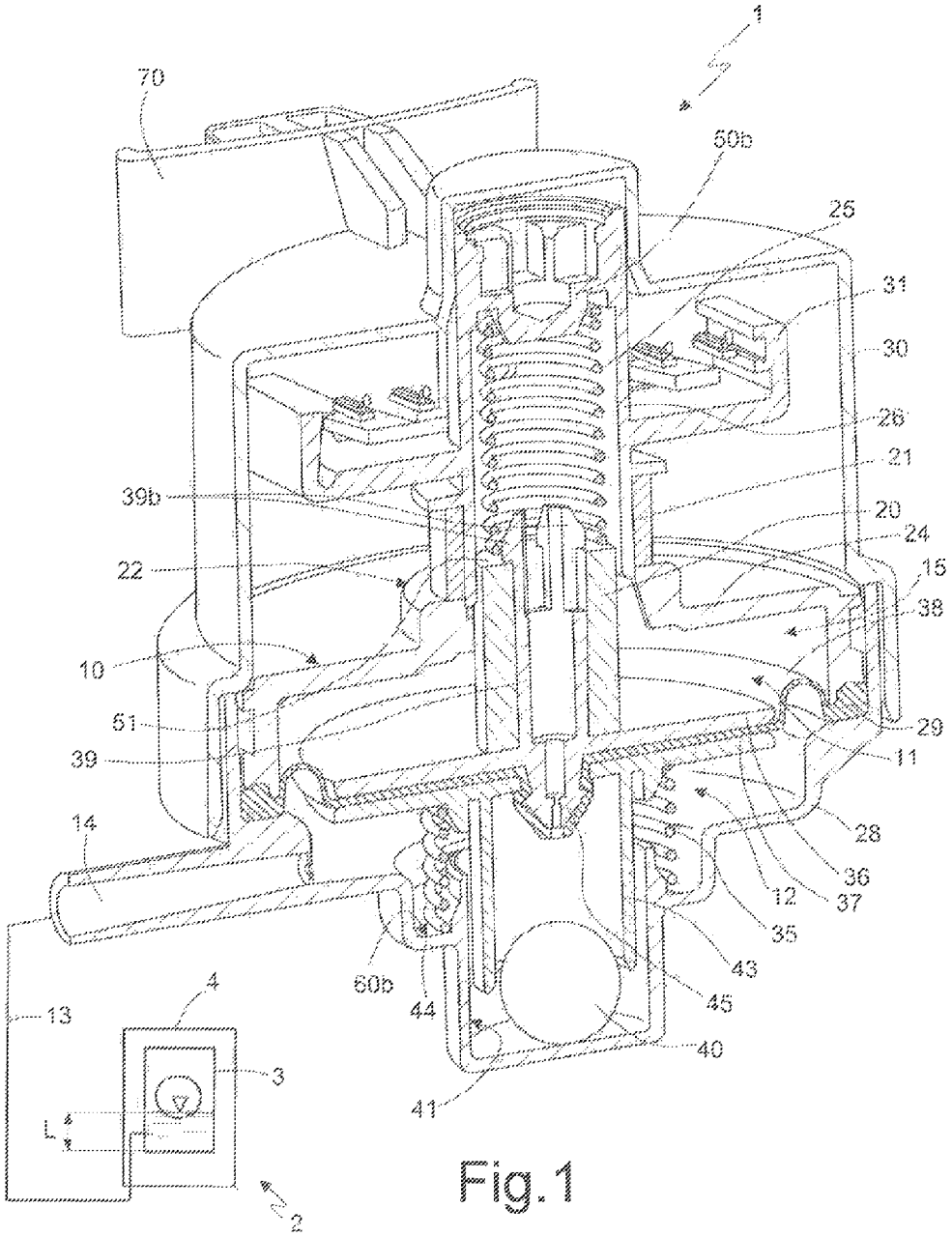
FIG. 1 diagrammatically shows a perspective section view of a pressure sensor according to the invention coupled to an electric household appliance.

With reference to FIG. 1, numeral 1 indicates as a whole a modified pressure sensors for detecting operating parameters of an electric household appliance 2, e.g. a washing or drying machine, featuring a component 3, e.g. a tank or basket, which is relatively movable with respect to a carcass 4 of the electric household appliance 2, in the case in point, in addition to a level L of liquid in the component 3 (i.e. the hydraulic pressure associated thereto), also the entity (direction and amplitude) of the vibrations to which component 3 (as well as the whole electric household appliance 2) is subjected in use, e.g. due to imbalanced load (e.g. laundry) contained in component 3, e.g. because of a bad instantaneous distribution of the load itself. Thereby, the electric household appliance 2 may be programmed in a known manner to either reduce or eliminate such an imbalance, e.g. by appropriately actuating the component 3.

Pressure sensor 1 comprises a rigid casing 10 accommodating a deformable membrane 11 sensitive to the hydraulic pressure present in a chamber 12 of sensor 1 connected in use to the component 3 (in this case, to the tank of the electric household appliance 2) by means of a tube 13 mounted to a nipple 14 of casing 10.

In particular, as well known to persons skilled in the art, membrane 11 fluid-tightly divides the interior of the casing 10 into a first chamber 15 and a second chamber, which is arranged in a position underneath the first one, consisting in chamber 12.

Chamber 15 is connected to atmosphere in a known manner, whereby is always at ambient pressure; on the other hand, chamber 12 is connected to a tank of the electric household appliance 2 by means of nipple 14, for measuring its liquid level, in this case to component 3 (i.e. the tank within which the basket rotates). Membrane 11 is thus subjected in use to a differential pressure equal to the pressure difference within the chambers 11 and 15 and, therefore, is deformed towards the chamber where there is the lowest pressure, in this case chamber 15, connected to atmosphere, as the liquid head L present in component 3 creates a higher pressure than atmospheric pressure at the nipple 14, which indeed depends on the level L.

Sensor 1 further comprises a core 20 made of ferromagnetic material and operatively associated to the membrane 11 for moving in the casing 10 in response to a deformation of membrane 11, and an electric winding 21, fixed to the casing 10 and operatively coupled to the core 20 to form a variable inductance inductor 22 therewith; in fact, according to the amount by which the core 20, mounted coaxially with the winding 21, enters within the space delimited by the winding 21 itself, the latter varies its inductance.

Chamber 15 is delimited by a first cup-shaped body 24 belonging to the casing 10 and accommodates the ferromagnetic core 20, which is integrally carried by membrane 11, and a contrast spring 25 for membrane 11; in particular, the cup-shaped body 24 is provided with a tubular end 26, which coaxially accommodates the spring 25 and carries the winding 21, externally to but at the chamber 15. On the other hand, chamber 12 is delimited by a second cup-shaped body 28 provided with the nipple 14, belonging to the casing 10 and snappingly coupled to the cup-shaped body 24, so as to fluid-tightly sandwich a peripheral edge 29 of membrane 11. The outer structure of sensor 1 is completed by a lid 30 covering the tubular end 26 and accommodating an electronic board 31 for powering the winding 21 and processing the signal thereof.

Chamber 12 further accommodates a second contrast spring 35 of membrane 11, opposite and antagonist to the spring 25. In order to support the core 20 and be able to cooperate with the springs 25 and 35, membrane 11 integrally carries two rigid discs 36 and 37 on opposite faces, which pinch it from opposite sides thus leaving a semi-toroidal, flexible annular portion 38 free in proximity of the peripheral edge 29; the disc 36 is provided with a tubular pin 39 with which the core 20 is coaxially and snappingly coupled, axially blocked between the disc 36 and respective teeth **39*b* of the tubular pin 39. Alternatively, core 20 may be glued to the pin 39**.

According to the invention, sensor 1 further comprises a mass 40 accommodated within the casing 10 in immediate proximity of said membrane 11, free to move with respect to the casing 10 at least in one direction corresponding to the axis of winding 21 and so that the inductor 22 is adapted to emit in use an electric signal in response to a variation of the position of mass 40 induced in use by a variation of position of the relatively movable component 3 with respect to the carcass 4 of the electric household appliance 2.

In the non-limitative example shown, the movable mass consists of a ball, e.g. made of metal, freely accommodated within a seat 41 inside the casing 10 and arranged opposite to the inductor 22 with respect to the membrane 11; the latter integrally carries a tubular element 43 mounted into the seat 41 for guiding the ball 40 so that the movements of the ball 40 are transmitted to the membrane 11, thus deforming it.

In practice, seat 41 is obtained in the cup-shaped body 28 as a shallow recess of an abutting wall 44 for the spring 35, coaxially to the same, and the tubular element 42 is obtained in one piece with the disc 37, on the side opposite to the pin 39 and coaxially thereto; disc 36 also carries a central pin 45 on the side opposite to pin 39, which central pin 45 protrudes towards the ball 40 within the tubular element 43 and coaxially to the same, and is fluid-tightly covered by the membrane 11. Pin 45 is also used to snappingly and integrally couple the two disc 36 and 37 to each other and to membrane 11.

Thereby, proportionally to the vibration of component 3, the ball 40 is alternatively oscillated by the vibrations towards the membrane 11 and towards the bottom of the seat 41, where it bounces back towards the membrane 11; therefore, whenever the ball 40 collides with pin 45 and membrane 11, it moves the latter by a pulse movement, towards the inductor 22, thus deforming the membrane 11 towards the chamber 15; spring 25 then moves the membrane 11 to the starting position again, while ball 40 drops towards the bottom of the seat 41; however, the movement of membrane 11 causes a corresponding movement of core 20, therefore generating a pulsing signal by the inductor 22, which signal is appropriately processed by the board 31.

Figure 2:
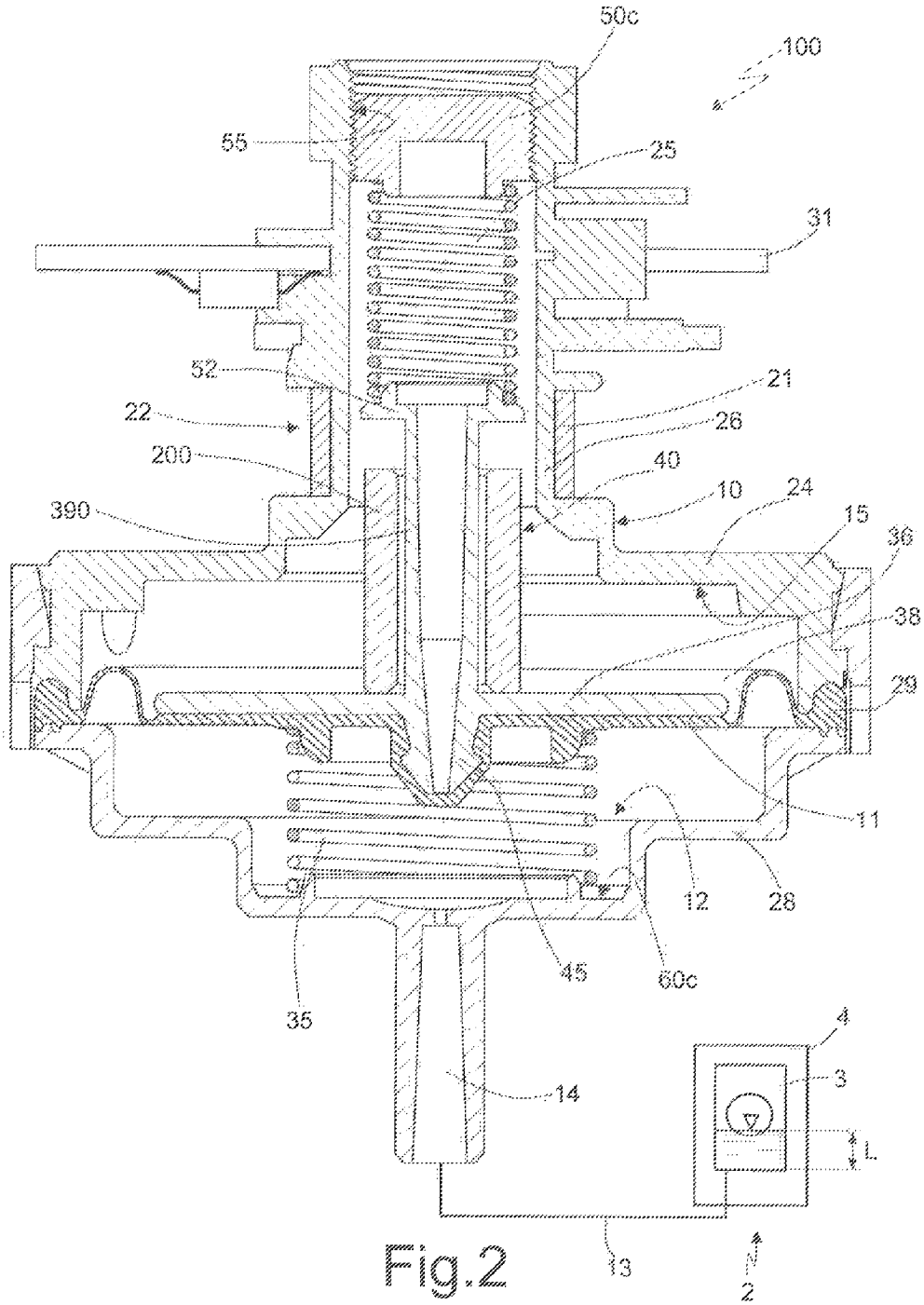
FIG. 2 diagrammatically shows a cross-section view of a different embodiment of the pressure sensor according to the invention coupled to an electric household appliance.

Referring now to FIG. 2, a pressure sensor 100 is shown, which is a possible preferred variant of the newly-described sensor 1. For simplicity, similar or equivalent details to those already described will be indicated by the same numbers.

Sensor 100 also comprises a casing 10 manufactured by moulding a synthetic plastic material, as in the case of sensor 1, consisting of two cup-shaped bodies 24 and 28 delimiting the chambers 15 and 12 and snappingly coupled to each other so as to fluid-tightly pinch an edge 29 of the membrane 11 therebetween, which fluid-tightly divides the chambers 12 and 15; chamber 15 is connected to atmosphere in a known manner, chamber 12 to the tank consisting of component 3, by means of a nipple 14 which in this case is axial instead of being radial.

Membrane 11 integrally carries a disc 36 on the side of chamber 15, which disc is snappingly coupled thereto by means of the pin 45 axially protruding from the chamber 12. Disc 36 is provided coaxially to the winding 21, which is in turn externally carried by the tubular end 26 of the cup-shaped body 24, and with a pin 390 opposite to pin 45, longer than pin 39 and free from the teeth 39*b*.

According to the invention, in this case the movable mass 40 consists of a ferromagnetic core 200 of the inductor 22, which is mounted in an axially sliding manner to the pin 390, which thus acts as a guiding pin, integrally carried by the membrane 11 on the side of winding 21 and coaxially to the latter.

Thereby, the core 200 is carried by the membrane 11, because it rests on the disc 36 and is engaged by the pin 390, and therefore in use it may move in response to the deformation of membrane 11 caused by the pressure in chamber 12, similarly to the core 20 in sensor 1. Simultaneously, however, the core 200 may also move in relation to the membrane 11 by sliding along the pin 390, e.g. in response to a variation of position of the relatively movable component 3 of the electric household appliance 2 with respect to the carcass 4.

The vibrations of component 3 are indeed transmitted to the casing 10 and from the latter to the free mass consisting of the sliding core 200, thus making the latter alternatively move along the pin 390 and thus producing an inductance variation of the inductor 22 without the membrane 11 varying the deformation status thereof, which will therefore only depend on the pressure in chamber 12, i.e. on the liquid level L in the component 3.

In both embodiments described, the contrast spring 25 is sandwiched between membrane 11 and a first abutting element 50 of the casing 10; in this case, in sensor 1, the spring 25 abuttingly rests against one end 51 of core 20 facing towards the winding 21 and against a bottom wall 50*b* of tubular end 26 of the cup-shaped body 24; in sensor 100, instead, the spring 25 abuttingly rests against a goblet-shaped end 52 of pin 390 facing towards the winding 21 and a threaded cap 50*c* screwed within the tubular end 26 of the cup-shaped body 24, into a threaded seat 55.

Similarly, the contrast spring 35, arranged on the side opposite to the spring 25, is sandwiched between membrane 11 and a second abutting element 60 of the casing 10, arranged on the side opposite to 50 and to winding 21. In sensor 1, the spring 35 abuttingly rests against the disc 37 and, on the opposite side, against an inner surface 60*b* of the wall 44 provided with the shallow recess defining the seat 41 for the ball 40. In sensor 100, the spring 35 abuttingly rests directly against the membrane 11, but in a position facing the disc 36, which thus acts as a rigid contrast element, and, on the opposite side, against a bottom wall 60*c* of the cup-shaped body 28, provided with the nipple 14.

Finally, lid 30 (not shown in sensor 100 for simplicity, but however present) carries a bracket 70 for snappingly fastening the sensor 1 or 100 either to component 3 or to carcass 4 of the electric household appliance 2, indifferently.

The invention claimed is:

1. A modified pressure sensor for detecting operating parameters of an electric household appliance, e.g. a washing or drying machine, provided with a relatively movable component with respect to a carcass of the electric household appliance, e.g. a tank or a basket, comprising a rigid casing accommodating a deformable membrane sensitive to hydraulic pressure, a core made of ferromagnetic material and operatively associated to the membrane for moving inside the casing in response to a deformation of the membrane, a winding fixed to the casing and operatively coupled to the core to form a variable inductance inductor; characterized in that it further comprises a mass accommodated in the casing in the immediate proximity of said membrane, free to move with respect to the casing in at least one direction corresponding to the axis of the winding and so that the inductor is adapted to emit an electric signal in response to a variation of the position of said mass induced, in use, by a variation of the position of the relatively movable component with respect to the carcass.

2. A sensor according to claim 1, characterized in that said movable mass consists of a ball freely accommodated into a seat inside the casing and arranged opposite to the inductor with respect to said membrane; the latter integrally carrying a tubular element mounted into the seat for guiding the ball so that the movements of the ball are transmitted to the membrane thus deforming it.

3. A sensor according to claim 1, characterized in that said movable mass consists of said ferromagnetic core of the inductor, which is axially and slidingly mounted to a guiding pin integrally carried by the membrane on the side of said winding and coaxially to the latter, so as to be carried by the membrane for moving, in use, in response to the deformation of the latter, and simultaneously, for being able to move in relation to the membrane in response to said variation of position of the relatively movable component of the electric household appliance with respect to the carcass.

4. A sensor according to claim 1, characterized in that it comprises a first contrast spring for the membrane, sandwiched between this one and a first abutting element of the casing; and a second contrast spring for the membrane, arranged opposite to the first, sandwiched between the membrane and a second abutting element of the casing, arranged opposite to the first and to said winding.

5. A sensor according to claim 4, characterized in that said first abutting element is defined by a threaded cap movably carried by the casing within a respective threaded seat thereof.

6. A sensor according to claim 4, characterized in that said casing is internally fluid-tightly divided, by said membrane, into a first and a second chamber; the first chamber accommodating said ferromagnetic core and said first spring and being externally provided with said winding; and said second chamber accommodating said second spring and being provided with a nipple for the connection to a tank of the electric household appliance.

7. A pressure sensor configured to detect operating parameters of an electric household appliance including a movable component, the sensor comprising:

a carcass;

a deformable membrane sensitive to hydraulic pressure;

a rigid casing accommodating the deformable membrane;

a core made of ferromagnetic material and operatively associated to the membrane and configured to move inside the casing in response to a deformation of the membrane;

a winding fixed to the casing and operatively coupled to the core to form a variable inductance inductor;

a mass accommodated in the casing in the immediate proximity of said membrane, wherein the sensor is configured such that:

the mass is free to move with respect to the casing along at least one axis at least generally corresponding to the axis of the winding;

the inductor emits an electric signal in response to a variation of the position of said mass; and movement of the mass is induced by a variation of the position of the relatively movable component with respect to the carcass.

8. A sensor according to claim 7, wherein said movable mass comprises a ball, wherein the sensor is configured such that the ball is freely accommodated into a seat inside the casing and arranged opposite to the inductor with respect to said membrane; the latter integrally carrying a tubular element mounted into the seat configured to guide the ball so that the movements of the ball are transmitted to the membrane, thereby deforming the membrane.

9. A sensor according to claim 7, wherein the sensor includes a guide pin integrally carried by the membrane on the side thereof that is the same side on which the winding is located, and wherein said movable mass comprises said ferromagnetic core of the inductor, which is axially and slidingly mounted to the guiding pin integrally carried by the membrane on the side of said winding and coaxially to the latter, so as to be carried by the membrane for moving, in use, in response to the deformation of the latter, and simultaneously, for being able to move in relation to the membrane in response to said variation of position of the relatively movable component of the electric household appliance with respect to the carcass.

10. A sensor according to claim 7, wherein the sensor further comprises a first contrast spring biasing the membrane in a first direction, sandwiched between the membrane and a first abutting element of the casing, and a second contrast spring biasing the membrane in an opposite direction from the first direction, arranged opposite to the first contrast spring, sandwiched between the membrane and a second abutting element of the casing, arranged opposite to the first abutting element and to said winding.

11. A sensor according to claim 10, wherein the first abutting element is defined by a threaded cap movably carried by the casing within a respective threaded seat thereof.

12. A sensor according to claim 11, wherein the casing is internally fluid-tightly divided, by said membrane, into a first and a second chamber, the first chamber accommodating said ferromagnetic core and said first spring and being externally provided with said winding; and said second chamber accommodating said second spring and being provided with a nipple for fluid communication connection with a tank of the electric household appliance.

13. A sensor according to claim 12, wherein said second chamber accommodates said free mass.

14. A device, comprising:

a washing machine including the sensor of claim 7, wherein the electric household appliance is the washing machine.

15. A device, comprising:

a drying machine including the sensor of claim 7, wherein the electric household appliance is the drying machine.

16. A device, comprising:

at least one of a tank or a basket; and the sensor of claim 7, wherein the relatively movable component is the at least one of a tank or a basket.

17. A device, comprising:

a clothes washing and/or drying machine, including:

an assembly configured to rotate a component thereof, the assembly including at least one of a tank or basket; and a pressure sensor in fluid communication with the assembly configured to rotate; wherein the sensor includes a variable inductance inductor including a ferromagnetic component that is movable in response to a variation of position of at least one of the tank or basket, the variable inductance inductor is configured to produce an electric signal in response to a variation of the position of said ferromagnetic component in response to the variation of the position of at least one of the tank or basket, and wherein the sensor is configured to output the electric signal.

18. The device of claim 17, wherein:

the device is configured such that movement of the assembly configured to rotate creates a pressure change in a fluid circuit extending between the assembly configured to rotate and the pressure sensor that induces movement of the ferromagnetic component.

19. The device of claim 17, wherein:

the sensor is configured with a movable mass that is freely movable relative to all parts of the ferromagnetic mass, and wherein the sensor is configured such that the movable mass moves in response to a variation of position of at least one of the tank or basket, thereby moving the ferromagnetic mass in response to a variation of position of at least one of the tank or basket.

20. The device of claim 17, wherein:

the sensor is configured with a diaphragm that is in a fixed relationship with the ferromagnetic mass, and wherein the sensor is configured such that the diaphragm moves in response to a variation of position of at least one of the tank or basket, thereby moving the ferromagnetic mass in response to a variation of position of at least one of the tank or basket.

* * * * *